US005904350A

United States Patent [19]

Creighton et al.

[11] Patent Number: 5,904,350

[45] **Date of Patent: *May 18, 1999**

[54] APPARATUS AND METHOD FOR DESKEWING MEDIA IN A PRINTER

[75] Inventors: Charles D. Creighton, Vancouver, Wash.; Nathan E. Hult, Tualatin, Oreg.; Richard G. Chambers, Portland, Oreg.; Clark W. Crawford; Mark A. Telander, both of Wilsonville, Oreg.; Donald B. MacLane, Portland, Oreg.

[73] Assignee: Tektronix, Inc., Wilsonville, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/791,713

[22] Filed: Jan. 31, 1997

[51] Int. Cl.[6] ..... B65H 7/02

[52] U.S. Cl. ..... 271/227; 271/242; 271/188

[58] Field of Search ..... 271/242, 243, 271/244, 245, 246, 247, 227, 228, 188

[56] References Cited

U.S. PATENT DOCUMENTS

| | | | |
|---|---|---|---|
| 4,878,657 | 11/1989 | Ura et al. | 271/242 |
| 5,022,642 | 6/1991 | Hasegawa et al. | 271/242 |
| 5,167,409 | 12/1992 | Higeta | 271/255 |
| 5,258,779 | 11/1993 | Serizawa | 346/134 |
| 5,427,462 | 6/1995 | Jackson | 400/579 |
| 5,455,604 | 10/1995 | Adams et al. | 346/138 |
| 5,543,909 | 8/1996 | Quesnel | 355/317 |
| 5,564,847 | 10/1996 | Patrick et al. | 271/188 |
| 5,692,744 | 12/1997 | Funato | 271/242 |

FOREIGN PATENT DOCUMENTS

| | | | |
|---|---|---|---|
| 0027855 | 2/1986 | Japan | 271/242 |
| 0197344 | 9/1986 | Japan | 271/242 |
| 0154553 | 6/1988 | Japan | 271/242 |
| 403279143 | 12/1991 | Japan | 271/242 |
| 406100208 | 4/1994 | Japan | 271/242 |
| 406191686 | 7/1994 | Japan | 271/242 |

*Primary Examiner*—H. Grant Skaggs
*Attorney, Agent, or Firm*—Charles F. Moore

[57] ABSTRACT

A method and apparatus for deskewing a sheet of media traveling through a paper path in a printer is provided. A buckle is formed in the sheet of media by over-driving the sheet into stationary deskew rollers that form a deskew nip downstream. A deskewing bias element includes a plurality of articulated segmented surfaces that contact the buckle and urge the leading edge of the sheet into the deskew nip. The buckle force combined with the biasing force from the deskewing bias element aligns the leading edge of the sheet with the deskew nip across the full width of the sheet, thereby removing any skew.

12 Claims, 6 Drawing Sheets

APPARATUS AND METHOD FOR DESKEWING MEDIA IN A PRINTER

FIELD OF THE INVENTION

The present invention relates generally to a media transport mechanism in an imaging apparatus and, more particularly, to a method and apparatus for deskewing media as it travels through a paper path in a printer.

BACKGROUND OF THE INVENTION

The field of imaging is replete with references describing various mechanisms and methods for transporting media through an imaging apparatus. Many of the transport mechanisms include provisions for properly aligning or deskewing individual sheets of media as they travel through the mechanism.

Several prior art patents teach the concept of creating a buckle in a sheet of media to correct for media skew. An exemplary patent disclosing this concept is U.S. Pat. No. 5,543,909 for TWO STEP, LARGE LATITUDE, STALLED ROLL REGISTRATION SYSTEM (the '909 patent). The '909 patent teaches a media feed apparatus for deskewing a media sheet and adjusting the timing of the feed of the sheet through the printer. A media sheet 110 is advanced substantially horizontally along a paper path by a preregistration nip 153. As shown in FIG. 1 of the '909 patent, the sheet lead edge is over-driven into a stalled registration nip 159 until a deskew buckle is formed in the sheet. The spring force of the deskew buckle coupled with the gravitational force pulling the sheet and buckle downwardly tends to urge the sheet lead edge toward the registration nip 159 and correct any skew in the sheet.

After the deskew buckle is formed in the '909 patent, the registration nip 159 is activated and the sheet 110 is fed through the registration nip a fixed distance until the sheet lead edge trips a downstream sensor 160. If paper feed timing adjustments are required, the registration nip 159 is again stopped and the preregistration nip 153, which is driven continuously, feeds a trailing portion of the sheet toward the registration nip 159, thereby creating a timing buckle in the sheet. As shown in FIG. 2, the timing buckle can be much larger than the deskew buckle. The size of the timing buckle is limited by a movable buckle chamber member 155. After a predetermined time, the registration nip 159 is activated and the sheet 110 continues along the paper path.

It is also known in the art to deskew a sheet lead edge by rotating in reverse a roller assembly that forms a nip. One prior art patent that discloses this concept is U.S. Pat. No. 5,427,462 for a METHOD AND APPARATUS FOR PAPER CONTROL AND SKEW CORRECTION IN A PRINTER (the '462 patent). This patent teaches advancing a sheet of media into a nip and slightly therebeyond. The rollers are then rotated in reverse, causing the lead edge of the sheet to jiggle or dance within the nip and settle parallel with the nip under its own weight.

While the apparatus described in the '909 and '462 patents assist in deskewing media, they also contain several drawbacks. For example, when a sheet of media is conveyed substantially upwardly and a buckle is formed, gravity tends to pull the buckle and the leading edge of the sheet downwardly and away from a registration nip. Similarly, if the sheet is conveyed around a corner, the buckle spring force is directed towards and substantially absorbed by the paper guides defining the corner. In either event, the sheet is either incompletely deskewed or not deskewed at all, and a jam or misfeed may result. This problem is particularly apparent with lightweight media having a low stiffness, in which case the buckle spring force is small to begin with. Thus, a need exists for an improved apparatus for deskewing media that overcomes the drawbacks of the prior art.

SUMMARY OF THE INVENTION

It is an aspect of the present invention to provide an apparatus and method for deskewing sheets of print media as they are transported through a paper path in a printer.

It is a feature of the present invention that the deskewing apparatus and method can effectively handle media of various sizes, weights and thicknesses.

It is another feature of the present invention that a buckle in the media is positively biased towards a deskewing nip so as to urge the leading edge of the media into the deskewing nip to correct any skew in the media.

It is yet another feature of the present invention that a plurality of articulated segmented surfaces create a biasing force that is distributed across a full width of the buckle.

It is an advantage of the present invention that the apparatus and method may be utilized to correct skewed media travelling substantially upwardly in a paper path.

It is another advantage of the present invention that the apparatus and method may be utilized to correct skewed media travelling around a corner downstream from the buckle in the media.

To achieve the foregoing and other aspects, features and advantages, and in accordance with the purposes of the present invention as described herein, an improved media deskewing apparatus and method are provided. The method and apparatus utilize positive biasing of a buckle formed in the media to urge the leading edge of the media into a deskewing nip. This positive biasing is distributed across a full width of the buckle, and allows the present invention to be used in paper paths oriented substantially upwardly and/or containing corners.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
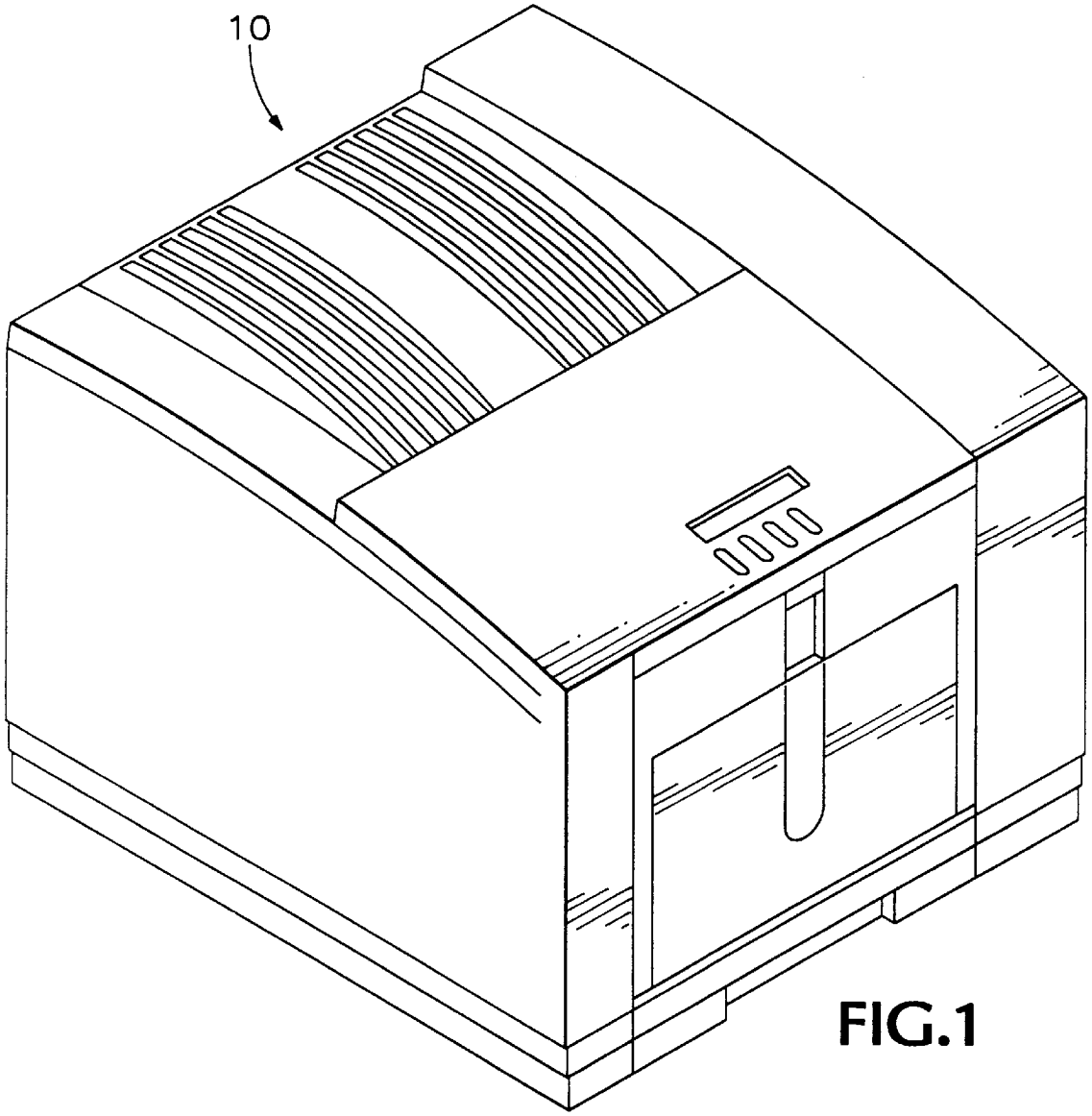
FIG. 1 is an overall perspective view of an ink jet printer that is particularly adapted for printing on a wide range of media types and sizes and utilizes the apparatus and method of the present invention.

FIG. 1 of the drawings shows an overall view of an ink jet color printer, generally represented by the reference numeral 10, that utilizes the apparatus and method for deskewing media of the present invention. An example of a suitable ink jet color printer with which the present invention may be utilized is disclosed in U.S. Pat. No. 5,389,958, entitled "IMAGING PROCESS" and assigned to the assignee of the present application. The '958 patent is hereby specifically incorporated by reference in pertinent part. It will be appreciated, however, that the method and apparatus of the present invention may be used with various other printing, imaging and/or copying apparatus that utilize different imaging technologies and architectures. Accordingly, the following description will be regarded as merely illustrative of one embodiment of the present invention.

Figure 2:
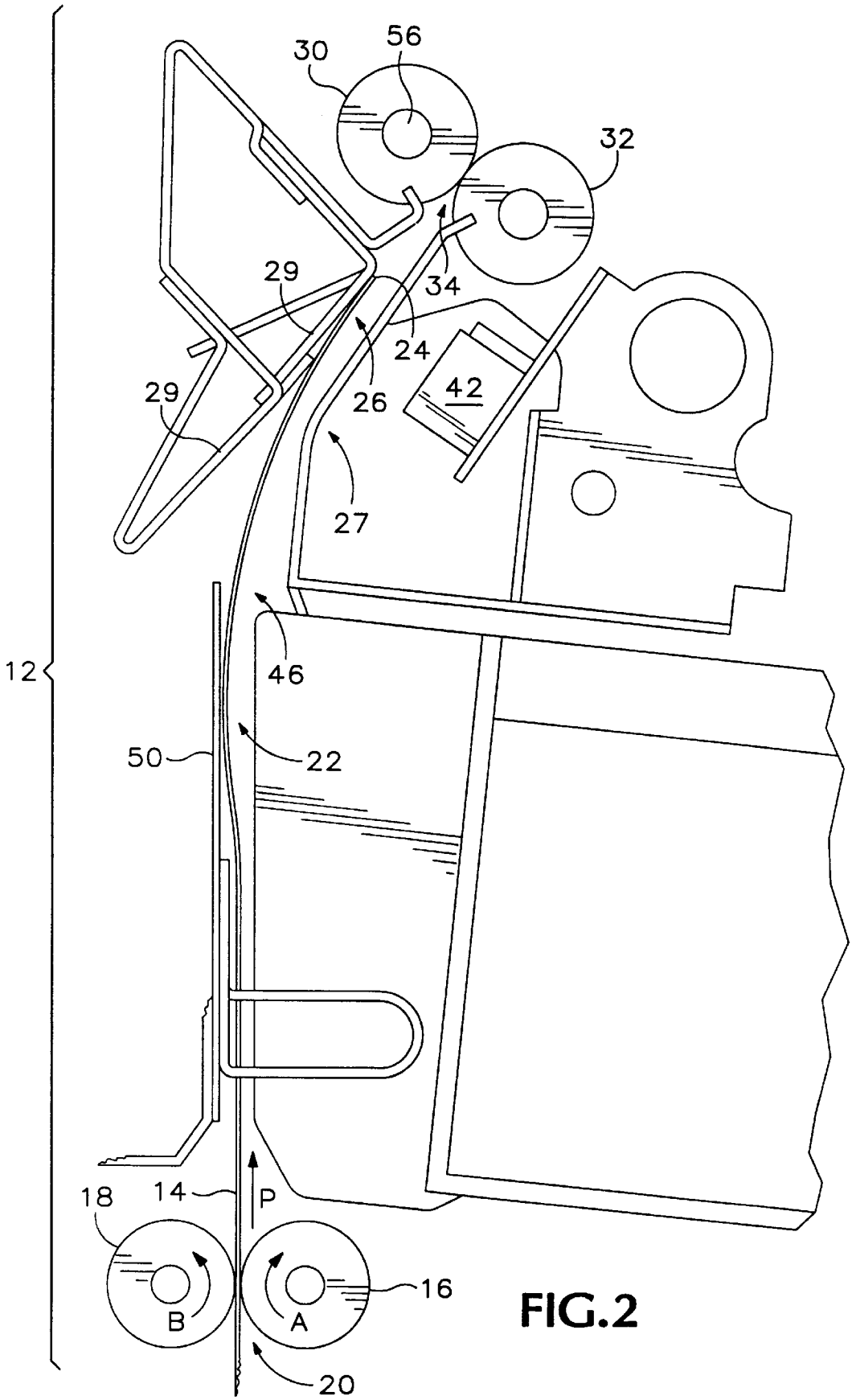
FIG. 2 is a side elevational view in partial cross section showing a sheet of print media travelling through a transport nip, substantially upwardly along a paper path and bending around a corner.
Figure 2A:
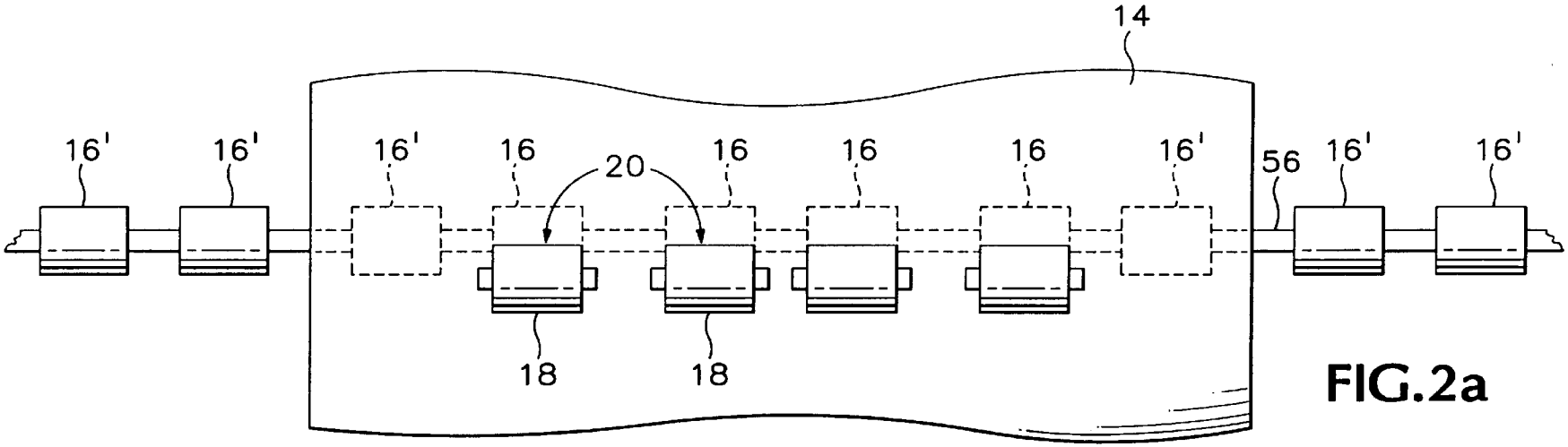
FIG. 2*a* is a front view showing the transport drive rollers and transport idler rollers advancing the media sheet.

With reference now to FIG. 2, the printer 10 includes a print media conveying apparatus, generally indicated by the reference number 12, for transporting a sheet of print media 14 to an imaging area of the printer (not shown). The print media conveying apparatus 12 utilizes a transport drive roller 16 and a transport idler roller 18 that is biased towards the drive roller 16 to define a transport nip 20 for advancing the sheet 14 in the direction of action arrow P. As shown in FIG. 2*a*, in the preferred embodiment four pairs of transport drive and transport idler rollers 16, 18 are utilized to create four individual transport nips 20 for advancing the sheet 14. In this manner, only approximately the middle five inches of the sheet 14 are constrained within the transport nips 20, thereby leaving the outer ends of the sheet unconstrained to allow for unequal forces across the width of the sheet without wrinkling. As FIG. 2*a* illustrates, the preferred embodiment also utilizes an additional three transport drive rollers 16' on each side of the middle four transport drive rollers 16 to allow the printer 10 to accommodate a wide range of media widths.

Returning to FIG. 2, the transport drive roller 16 is rotated in the direction of action arrow A to cause transport idler roller 18 to rotate in the direction of action arrow B and advance the sheet 14 through the transport nip 20 and upwardly along the paper path, generally indicated by the reference numeral 22. As explained in more detail below, the leading edge 24 of the sheet 14 advances through an upper portion 26 of the paper path 22, and is guided to contact a stationary deskew idler roller 30 (see also FIGS. 3 and 5). As these figures illustrate, the upper portion 26 of the paper path 22 is angled from the vertical to bend the sheet 14 around a corner 27. The deskew idler roller 30 and an adjacent deskew drive roller 32 form a deskew nip 34. In the preferred embodiment of the present invention as shown in FIG. 4, ten pairs of deskew idler and drive rollers 30, 32 are utilized to form 10 individual deskew nips 34 across the width of the paper path 22.

Figure 3:
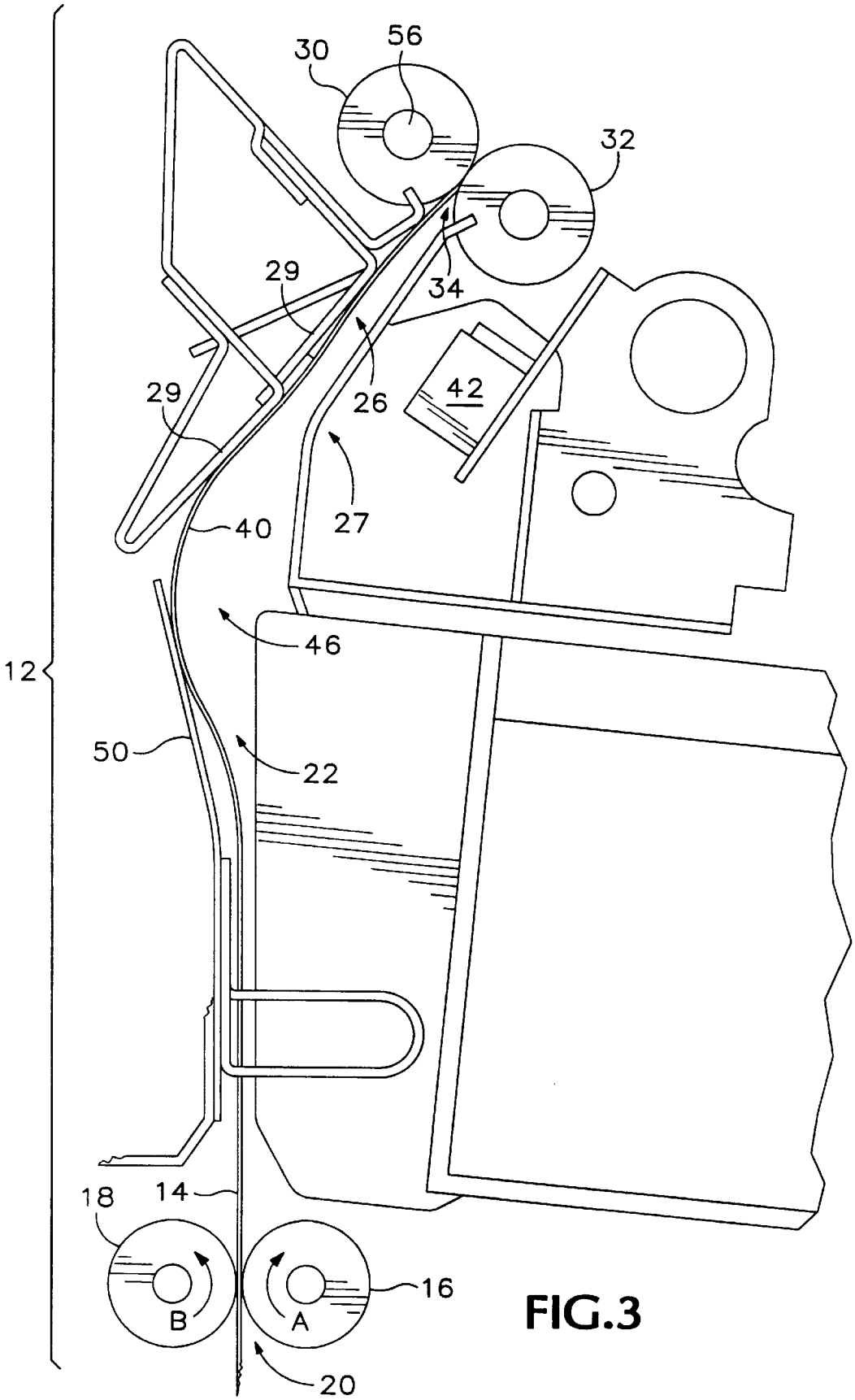
FIG. 3 is a side elevational view in partial cross section showing the leading edge of the sheet of print media contacting a deskew idler roller and a buckle being formed in the sheet and contacting a deskewing bias element.
Figure 4:
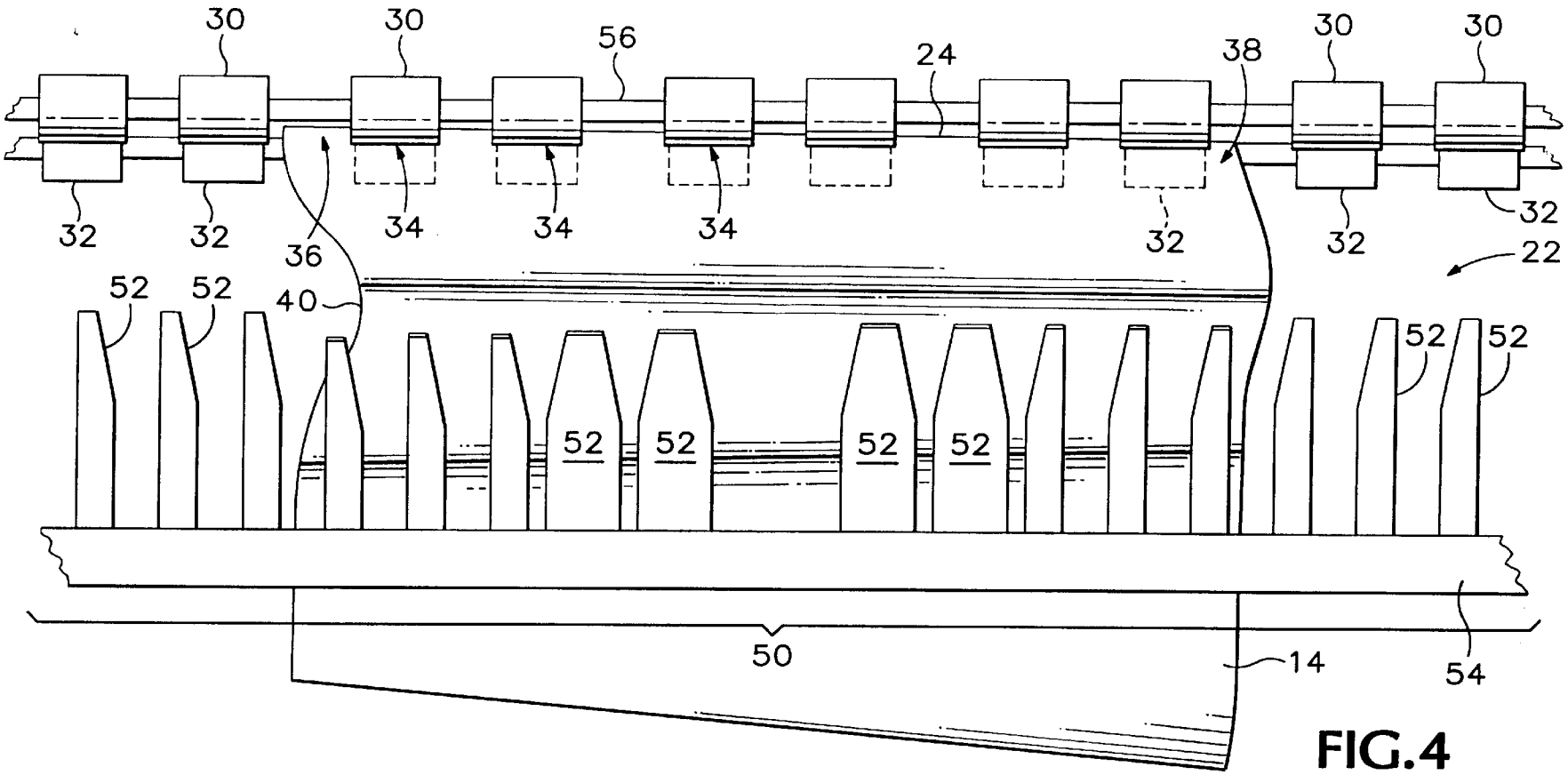
FIG. 4 is a front view showing the leading edge of the media sheet being skewed at the deskew rollers and the individual fingers of the deskewing bias element contacting the buckle in the sheet.

FIG. 4 illustrates a sheet 14 that is misaligned or skewed as it travels through the paper path 22. The skewed sheet 14 of FIG. 4 has a left side 36 that reaches the stationary deskew idler rollers 30 before a right side 38. As shown in FIG. 3, the upper portion 26 of the paper path 22 is angled from the vertical and is designed to guide the leading edge 24 of the sheet 14 into contact with the deskew idler roller 30 at a position on the roller that is sloping towards the deskew nip 34 (see also FIG. 5). The sheet 14 is then over-driven into the stationary deskew idler roller 30 to form a buckle 40 in the sheet. In the preferred embodiment, the size of the buckle 40 is predetermined by driving the sheet 14 a fixed distance after the leading edge 24 of the sheet trips a photosensor 42 that is positioned along the paper path 22.

With continued reference to FIG. 3, the buckle 40 is formed in a buckle cavity 46 that is located upstream from the corner 27 along the paper path 22. The buckle 40 in the sheet 14 creates a spring return force in the sheet that tends to urge the leading edge 24 into the deskew idler roller 30 and toward the deskew nip 34. The magnitude of this return spring force varies with the type, size, thickness and angular orientation of the media sheet 14.

Figure 5:
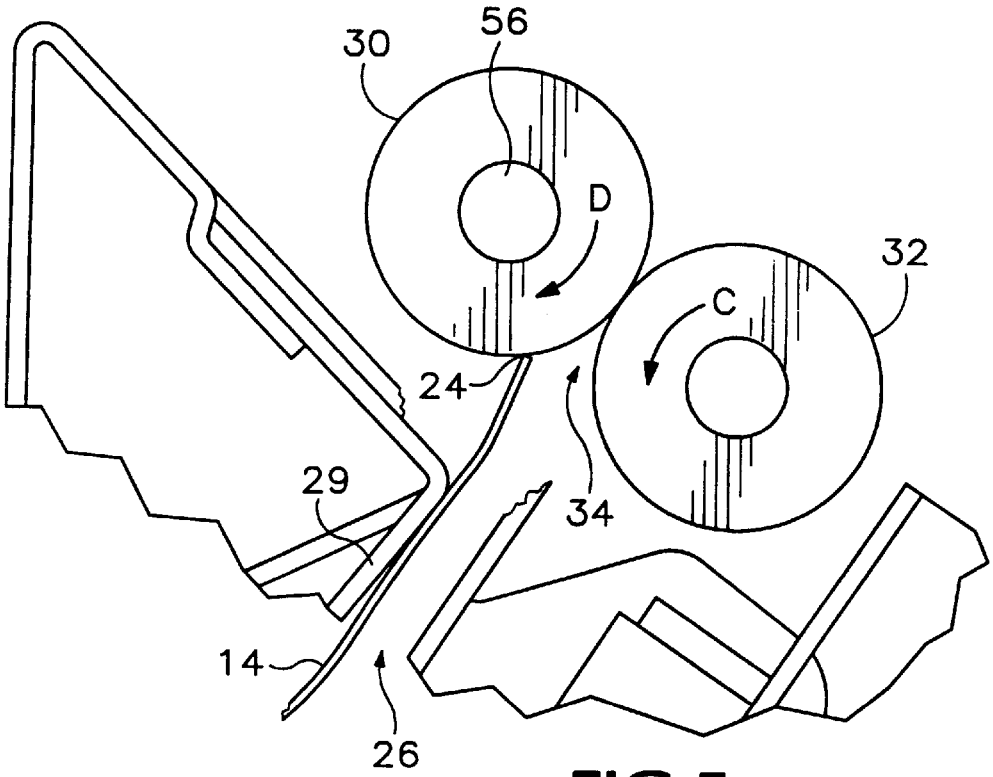
FIG. 5 is a schematic side view diagram showing the leading edge of the media sheet contacting the deskew idler roller.
Figure 6:
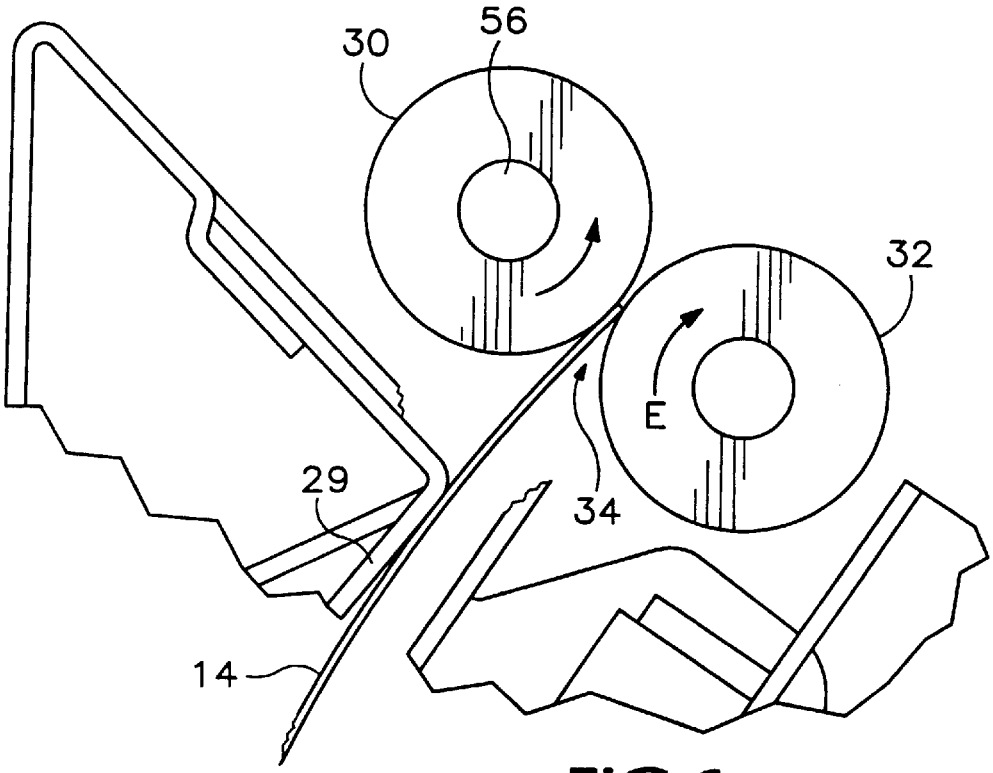
FIG. 6 is a schematic side view diagram showing the leading edge of the media sheet positioned within the deskew nip after the deskew rollers have been rotated in reverse.

With reference now to FIGS. 3 and 5, after the buckle 40 has obtained the predetermined size, the transport drive rollers 16 are stopped and the deskew drive rollers 32 are reverse rotated in the direction of action arrow C to cause the deskew idler rollers 30 to rotate in the direction of the action arrow D. In the preferred embodiment, the deskew drive and idler rollers 32, 30 are reverse rotated one revolution. By reversing the deskew drive and idler rollers 32, 30, the leading edge 24 of the sheet 14 is caused to chatter or skip against the surface of the deskew idler roller 30. In this manner, the frictional force holding the leading edge 24 on the surface of the deskew idler roller 30 is reduced and the spring return force created by the buckle 40 urges the leading edge 24 of the sheet 14 into the deskew nip 34, as shown in FIG. 6.

As described above, the method of creating a buckle in a sheet of media and reversing a pair of rollers to remove skew in sheet has been practiced in the prior art. It has been discovered, however, that this deskew method alone can prove unsatisfactory in several situations. For example, when thin and/or light media that is highly flexible is used, the spring return force created by the buckle is often insufficient to force the entire width of the leading edge into the nip, resulting in incomplete or no skew correction. When the paper path is orientated substantially upwardly as shown in FIGS. 2 and 3, the spring return force created by the buckle is reduced by gravitational forces that pull the buckle and leading edge of the sheet downwardly and away from the deskew nip. Additionally, when the paper path includes a bend or corner downstream from the buckle, the spring return force of the buckle is primarily directed into the guide surfaces defining the bend or corner. In this situation, only a small component of the buckle spring return force is transmitted around the bend and to the leading edge of the sheet. Therefore, to overcome these limitations of the prior art methods and apparatus, and in an important aspect of the present invention, a deskewing bias element 50 extends into the buckle cavity 46 to contact and positively bias the buckle 40 in the direction of the leading edge 24 and the deskew nip 34.

As illustrated in FIG. 2, the deskewing bias element 50 extends upwardly into the buckle cavity 46 to define a portion of the paper path 22 and to guide the sheet 14 toward the upper portion 26 of the paper path. As this figure illustrates, the sheet 14 is being transported substantially upwardly against gravity from the transport rollers 18, 16. Without the deskewing bias element 50, gravity would cause light or highly flexible media to curl outwardly and fall out of the buckle cavity 46, thereby causing a jam or misfeed. Advantageously, the deskewing bias element 50 eliminates this potential problem by acting as a guide surface for the media sheet 14 as it travels upwardly along the paper path 22.

With reference now to FIG. 4, as the left skewed side 36 of the sheet 14 reaches the deskew idler rollers 30, a buckle 40 begins to form on the left side 36 of the sheet. It will be appreciated that for clarity purposes FIG. 4 does not show the upper guide surfaces 29 of the paper path 22. As the sheet 14 is over-driven by the transport rollers 18, 16 into the deskew idler roller 30, the buckle 40 will continue to form unevenly across the width of the sheet 14, with a larger buckle eventually forming at the left side 36. Consequently, the leading edge 24 at the left side 36 will have a higher buckle force urging it toward the deskew nip 34 as compared to the right side 38 of the sheet 14. As illustrated in FIG. 4, the leading edge 24 at the left side 36 may be urged by the buckle forces into the deskew nip 34. However, the leading edge 24 near the right side 38 and for some distance inward from the right side will often not reach the deskew nip 34 and will be contacting the deskew idler roller 30 after the buckle 40 has been fully formed. As explained in more detail below, the deskewing bias element 50 advantageously distributes an additional biasing force in the direction of the leading edge 24 across the full width of the buckle 40 to urge the entire leading edge, including the right side 38, into the deskew nip 34.

With reference now to FIG. 3, as the buckle 40 is formed in the buckle cavity 46, the buckle contacts the upper guide surfaces 29 of the paper path 22 that angle the sheet 14 away from the vertical. As explained above, in this situation the buckle spring return force is normally directed into and absorbed primarily by the guide surfaces 29, leaving only a portion of the buckle force that is directed toward the leading edge 24. In the present invention, however, the buckle 40 contacts and deflects the deskewing bias element 50 outwardly from the cavity 46 prior to reaching the upper guide surfaces 29.

In the preferred embodiment of the deskewing bias element 50 as illustrated in FIG. 4, the deskewing bias element comprises a plurality of articulated segmented surfaces or fingers 52 that are cantilevered to extend laterally from a support flange 54. The fingers 52 are preferably made from a flexible material, such as plastic. Advantageously, the individual fingers 52 of the deskewing bias element 50 distribute a biasing force across the full width of the buckle 40 that directs the buckle spring return force toward the leading edge 24. Additionally, the individual fingers 52 may contact and bias a particular portion of the buckle 40 without being affected by the amount of deflection or bias provided by the other fingers across the width of the sheet 14. For example, with specific reference to FIG. 4, this advantageously allows the fingers 52 to contact and bias the buckle 40 at the right side 38 of the sheet 14 where the size of the buckle, and the corresponding buckle spring force, is smaller. In this manner, the fingers 52 are effective to urge the entire leading edge 24 into the deskew nip 34 across the full width of the sheet 14, even where the sheet traverses a bend 27 downstream from the buckle 40.

To provide maximum deflection in the fingers 52 and to generate maximum bias force on the buckle 40, it is also preferable that at least a portion of the fingers 52 contact the buckle 40 at substantially its apogee. Additionally, as shown in FIG. 4, the middle four fingers 52 are wider than the other fingers 52 to provide a greater biasing force for sheets of media having smaller widths.

After the deskew rollers 32, 30 have been driven in reverse and the leading edge 24 of the sheet 14 is within the deskew nip 34 across the entire width of the sheet 14, the deskew and transport drive rollers 32, 16 are driven in the direction of action arrows E and A, respectively, to advance the sheet 14 upwardly along the paper path 22, around the bend 27 and through the deskew nip 34 (FIGS. 3 and 6). Because the sheet 14 is continuously restrained within the transport nip 20 during the entire deskew process, the buckle 40 remains in the sheet as the sheet is fed through the deskew nip 34. Alternatively expressed, while the sheet is deskewed downstream from the buckle 40, it remains skewed upstream from the buckle. With reference to FIG. 4, this skew creates a yaw force at the deskew rollers 32, 30 that tends to force the left side 36 of the sheet 14 through the deskew nip 34 faster than the right side 38. Without correction, these unequal transport speeds would re-skew the sheet 14 at the deskew nip 34.

To prevent the sheet 14 from becoming re-skewed at the deskew nip 34, the ten deskew idler rollers 30 are each affixed to a rotatable shaft 56. Advantageously, this prevents the unequal yaw force loading from advancing the left side 36 of the sheet 14 through the deskew nip 34 faster than the right side 38. Alternatively expressed, by affixing all of the deskew idler rollers 30 to one shaft 56, the idler rollers are constrained to turn at the same speed, thereby preventing the skew from returning during transport of the sheet 14.

The foregoing description of a preferred embodiment of the invention has been presented for purposes of illustration and description. It is not intended to be exhaustive or to limit the invention to the precise form disclosed. Many changes, modifications, and variations in the materials and arrangement of parts can be made, and the invention may be utilized with various different printing apparatus, all without departing from the inventive concepts disclosed herein. The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally, and equitably entitled. All patents cited herein are incorporated by reference in their entirety.

What is claimed is:

1. A print media conveying apparatus in a printer for transporting and deskewing a sheet of print media, said sheet of print media having a leading edge, the print media conveying apparatus comprising:

a paper path through which the sheet of print media travels, said paper path having a buckle cavity that allows a buckle to form in the sheet of print media;

a plurality of pairs of transport rollers positioned upstream from said buckle cavity, each said pair of transport rollers including a transport dive roller and a transport idler roller, each said transport drive roller affixed to a common transport drive shaft, said plurality of pairs of transport rollers forming a plurality of transport nips within a nip plane through which the leading edge of said sheet of print media is fed;

at least one stand alone transport drive roller affixed to the common transport drive shaft and positioned on either side of the plurality of pairs of transport rollers, the stand alone transport drive rollers allowing outer portions of the sheet of media to advance unconstrained across the stand alone transport drive rollers to allow for unequal forces across a width of the sheet without wrinkling;

a plurality of pairs of deskew rollers positioned downstream from said buckle cavity said plurality of parts of deskew rollers forming a plurality of deskewing nips, each of the plurality of pairs of deskew rollers including a deskew idler roller, each of the deskew idler rollers being affixed to a common rotatable shaft so as to rotate at a common speed;

a deskewing bias element extending into said buckle cavity for contacting and biasing the buckle in the sheet of print media to urge the leading edge of said sheet of print media into at least a portion of the deskewing nips said deskewing bias elements including a plurality of articulated segmented surfaces for distributing a biasing force across a full width of the buckle in the sheet of print media so that a full length of the leading edge of the sheet is urged into the deskew nip: and a middle portion of the plurality of articulated segmented surfaces comprising plurality of primary articulated segmented surfaces, each of the primary articulated segmented surfaces having an equal width that is greater than a width of each of the articulated segmented surfaces on either side of the middle portion, said primary articulated segmented surfaces cooperating with the plurality of pairs of transport rollers to transport the sheet of media without wrinkling.

2. The print media conveying apparatus of claim 1, wherein said deskewing bias element biases the buckle in substantially the direction of the plurality of deskewing nips.

3. The print media conveying apparatus of claim 1, wherein said articulated segmented surfaces are flexible so as to be deflected by said buckle in said sheet of print media.

4. The print media conveying apparatus of claim 3, wherein said articulated segmented surfaces extend laterally from a support flange.

5. The print media conveying apparatus of claim 1, wherein at least a portion of said deskewing bias element contacts substantially the apogee of the buckle in the sheet of print media.

6. A method of deskewing a sheet of print media in a printer, the sheet of print media having a leading edge, the method comprising the steps of:

providing a paper path through which the sheet of print media travels, the paper path including a buckle cavity that allows a buckle to form in the sheet of print media;

providing a plurality of pairs of transport rollers positioned upstream from said buckle cavity, each said pair of transport rollers including a transport drive roller and a transport idler roller, each said transport drive roller affixed to a common transport drive shaft, said plurality of pairs of transport rollers forming a plurality of transport nips within a nip plane through which the leading edge of the sheet of print media is fed;

providing at least one stand alone transport drive roller affixed to the common transport drive shaft and positioned on either side of the plurality of pairs of transport rollers;

advancing outer portions of the sheet of media unconstrained across the stand alone transport drive rollers to allow for unequal forces across a width of the sheet without wrinkling;

providing a plurality of pairs of deskew rollers downstream from said buckle cavity, said plurality of pairs of deskew rollers defining a plurality of deskew nips;

providing a deskew idler roller in each of the plurality of pairs of deskew rollers;

affixing each of the deskew idler rollers to a common rotatable shaft;

rotating the deskew idler rollers at a common speed;

advancing the sheet of print media along the paper path until at least a portion of the leading edge of the sheet contacts at least one of the pair of deskew rollers;

causing the sheet of print media to form a buckle within the buckle cavity; and biasing the buckle in the sheet of print media width a biasing force that is greater in a middle portion of the buckle than in outer portions of the buckle to urge a full length of the leading edge of the sheet into at least a portion of the deskew nips whereby the leading edge of the sheet is deskewed.

7. The method of deskewing a sheet of print media of claim 6, wherein the step of biasing the buckle in the sheet of print media includes biasing the buckle in substantially the direction of the at least a portion of the deskew nips.

8. The method of deskewing a sheet of print media of claim 6, further including the step of causing at least a portion of the leading edge of the sheet of print media to chatter against at least one of the deskew rollers by rotating the plurality of pairs of deskew rollers in a direction that would convey the sheet toward the transport nip.

9. The method of deskewing a sheet of print media of claim 6, wherein the step of biasing the buckle in the sheet includes providing a deskewing bias element that contacts the buckle, the deskewing bias element including a plurality of articulated segmented surfaces for distributing a biasing force across a full width of the buckle so that a full length of the leading edge of the sheet is urged into the deskew nip, the plurality of articulated segmented surface including a middle portion comprising a plurality of primary articulated segmented surfaces, each of the primary articulated segmented surfaces having an equal width that is greater than a width of each of the articulated segmented surfaces on either side of the middle portion of primary articulated segmented surfaces, said primary articulated segmented surfaces cooperating with the plurality of pairs of transport rollers to transport the sheet of media without wrinkling.

10. The method of deskewing a sheet of print media of claim 9, wherein the articulated segmented surfaces comprise a plurality of fingers that extend laterally from a support flange.

11. The method of deskewing a sheet of print media of claim 10, wherein at least one of the plurality of primary articulated segmented surfaces contacts substantially the apogee of the buckle.

12. The method of deskewing a sheet of print media of claim 6, further including the steps of detecting the leading edge of the sheet at a position upstream from the plurality of deskewing nips and continuing to advance the sheet along the paper path for a fixed period after the leading edge is detected to form the buckle.

* * * * *